US005664690A

United States Patent [19]

Friesen

[11] Patent Number: 5,664,690

[45] Date of Patent: Sep. 9, 1997

[54] SLIDING DISPLAY DRAWER

[76] Inventor: James W. Friesen, 616 N. Hallock St., San Dimas, Calif. 91773

[21] Appl. No.: 289,690

[22] Filed: Aug. 12, 1994

[51] Int. Cl.[6] ..... A47F 5/00

[52] U.S. Cl. ..... 211/88.01; 211/106; 248/302; 248/312.1; 248/220.41

[58] Field of Search ..... 211/88, 106, 126, 211/86; 248/302, 312.1, 220.3, 220.4, 221.1

[56] References Cited

U.S. PATENT DOCUMENTS

| | | | |
|---|---|---|---|
| 1,916,391 | 9/1933 | Reedy et al. | 126/339 |
| 1,934,125 | 11/1933 | Hurt | 126/339 |
| 2,245,882 | 6/1941 | Visser | 206/195 |
| 2,942,925 | 6/1960 | Behling | 211/88 X |
| 3,712,696 | 1/1973 | McDonnell | 211/88 X |
| 4,339,102 | 7/1982 | Schweitzer | 248/221.1 |
| 4,597,616 | 7/1986 | Trubiano | 312/246 |
| 4,655,351 | 4/1987 | Walker | 211/88 |
| 4,813,535 | 3/1989 | Radocha et al. | 206/4.12 |
| 4,863,131 | 9/1989 | Kinseley | 248/220.4 |
| 5,318,187 | 6/1994 | Rosenthal | 211/88 |
| 5,358,128 | 10/1994 | Belokin et al. | 211/88 X |

*Primary Examiner*—Robert W. Gibson, Jr.
*Attorney, Agent, or Firm*—Lyon & Lyon LLP

[57] ABSTRACT

In a merchandising display device, a peg board or other support is utilized to support a frame which is constructed of metal rods. A plastic receptacle is inserted into the frame, and products are placed inside the receptacle for bulk display. The receptacle slides in and out of the frame allowing customers to retrieve products therefrom. A group of the frame and receptacle combinations can be arranged on a peg board support to form a patterned display device. The frame is attached to the peg board with the use of J hooks and stabilizing pins. The frame is provided with a stop to prevent the accidental removal of the receptacle from the frame. Further, the receptacle is provided with a flat area for the placement of identifying labels.

21 Claims, 7 Drawing Sheets

SLIDING DISPLAY DRAWER

BACKGROUND OF THE INVENTION

The field of the present invention is merchandising display systems and devices.

Merchandising units which utilize peg board display panels with attached shelves or arms are well known. Such peg board panels are advantageous because any number of shelves or hanging arms can be accommodated without the use of fasteners and without having to mount such shelves or arms permanently to a wall. Vertical peg board panels may have further advantages in that they can accommodate hook type brackets at almost any desired location, thus eliminating the need for fasteners.

When a product is held directly by an arm, it is usually in the form of a blister pack or other prepackaged product; however, an arm can be readily used to suspend paint brushes and other hangable items as well. Small items such as screws, bolts, nuts, and washers present unique problems for the typical merchandising display devices. These items are generally small and add up to a significant amount of weight when displayed in bulk. Therefore, these items have conventionally been displayed in some type of prepackaged product and hung on a display arm or displayed in a cabinet of discreet receptacles or drawers with the cabinet set on a shelf or the floor. Because of ecological concerns and the desire to reduce the amount of disposable packaging, the prepackaging of nuts and bolts and other similar items in plastic bags for display upon an arm may be undesirable. Another method of display for bulk items is in cabinets of trays or drawers. Such displays must be placed on the floor or on a very sturdy shelf because of the weight inherent in a large display of screws, nuts, bolts, and washers. Thus, many cabinets, especially large ones, are inconveniently located very close to or actually on the floor. Further, it is expensive to build shelves with the necessary stability to contain a display cabinet for the above bulk items, and the display itself must be short enough to provide sufficient balance and prevent tipping while customers are retrieving products from the display.

SUMMARY OF THE INVENTION

The present invention is directed to a merchandise display device providing an effective and inexpensive use of space for the bulk display of small but relatively heavy products. To this end, a receptacle having a flange is placed inside of a frame which allows the receptacle to slide relative to the frame on the flanges. The frame is then connected to a support. The support can be a peg board to which the frame is connected by J hooks which are integral to the frame. Additional support may include one or more stabilizing pins inserted into the peg board. The frame may be constructed from strong rods and with at least one longitudinal support rod on the top of the frame. At least one of the longitudinal support rods has a recessed or bent segment which protrudes down into the receptacle, engaging said receptacle, and preventing accidental removal of the receptacle from the frame. The receptacle may be removed from the frame deliberately by forcing the receptacle over the recessed segment. The frames with the inserted receptacles are then arranged on the peg board in a desired pattern such as a tightly spaced column and row pattern.

Accordingly, it is an object of the present invention to provide an improved device for bulk display of small size but relatively heavy products. Other and further objects and advantages of this invention will appear from the following description of preferred embodiments and the accompanying drawings in which similar reference characters denote similar elements throughout the several views.

DETAILED DESCRIPTION OF THE PREFERRED EMBODIMENTS

Figure 1:
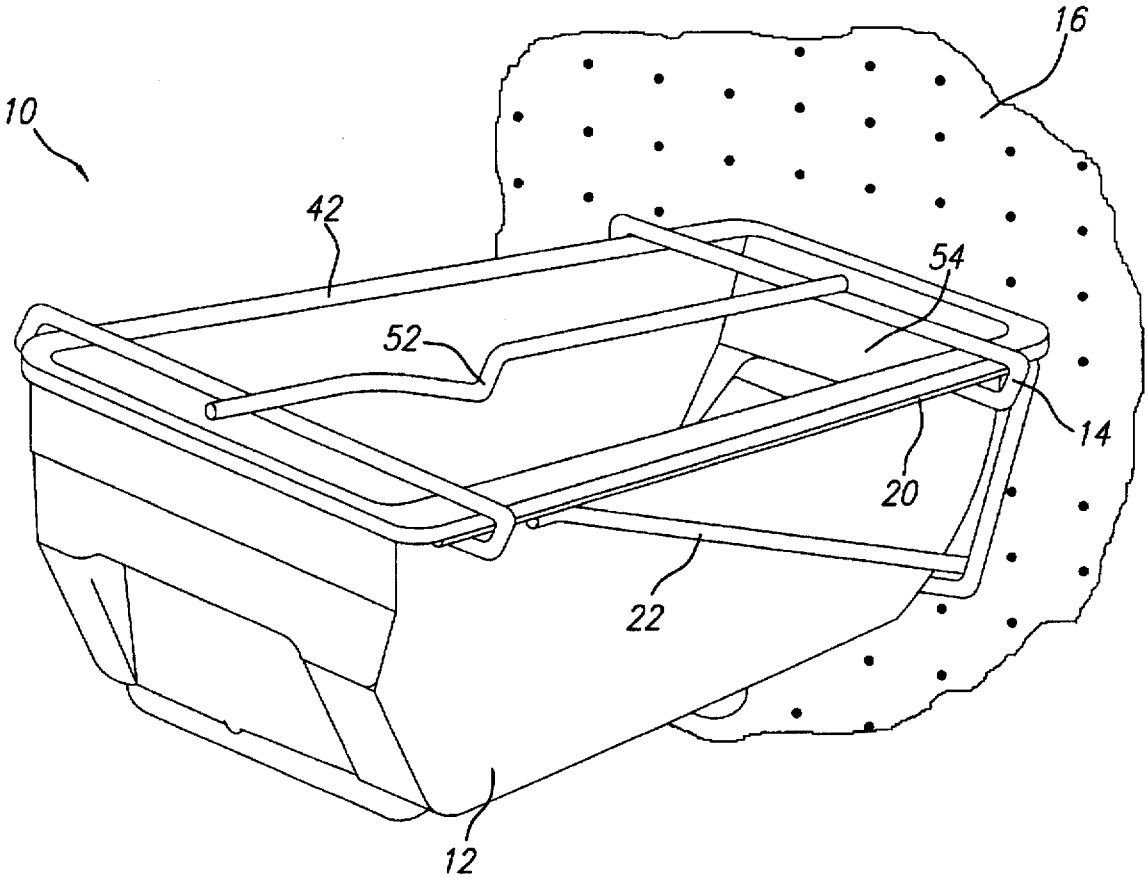
FIG. 1 is a perspective view of a receptacle slidably received by a rod frame which is attached to a peg board support.

Turning in detail to the drawings, FIG. 1 shows an individual display unit shown generally as 10 including a receptacle 12, rod frame 14, and peg board support 16. The receptacle is slidably placed inside of the frame 14, and the frame 14 is removably connected to the peg board support 16.

In a preferred embodiment illustrated by FIG. 1, the receptacle 12 and frame 14 are attached to the preferred peg board support 16. Though other supports such as a sheetrock wall could be used with the device by utilizing different attachment methods such as screws, the peg board support 16 is preferred because of the ease with which the frame 14 is attached and detached from the peg board support 16. Further, the peg board support 16 is advantageous because the receptacles 12 are easily arranged and rearranged in many patterns and with many spacings. Thus, as it becomes necessary to add more receptacles 12 to a display, the display is quickly rearranged in a compact pattern without sacrificing aesthetically pleasing elements of the patterns such as symmetry, or the functional elements of the pattern such as the arrangement or order of the products contained in the receptacles 12. In contrast, if a cabinet display devise were used, it might be necessary to purchase an entire new cabinet, or if the receptacles 12 were attached with screws to a wall, the receptacles 12 already attached might not readily be moved without great difficulty and repair to the wall. Therefore, the preferred peg board support 16 allows for the expansion or contraction of the display to meet stores's display needs for products during any season of the year.

Figure 2A:
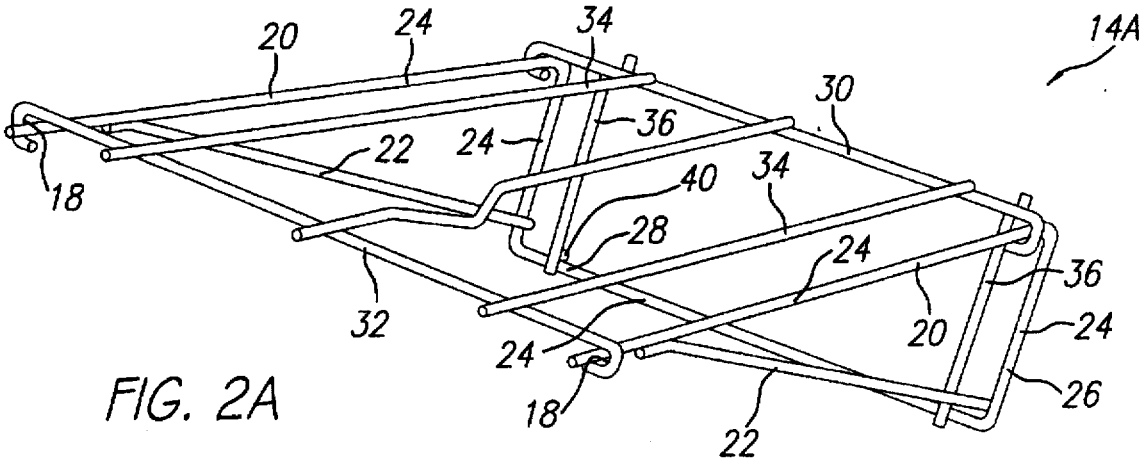
FIG. 2A is a perspective view of a large size frame having three longitudinal support rods.
Figure 2B:
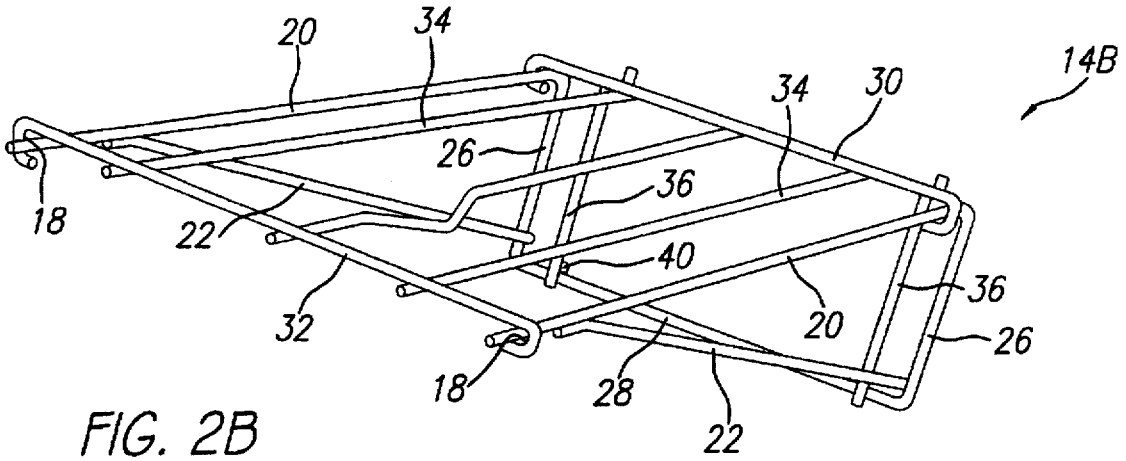
FIG. 2B is a perspective view of a medium size frame having three longitudinal support rods.
Figure 2C:
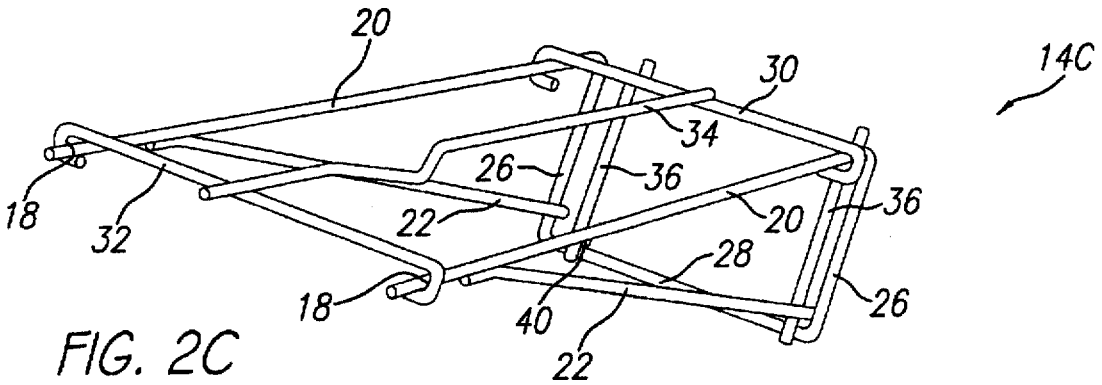
FIG. 2C is a perspective view of a small size frame having one longitudinal support rod.

Preferred embodiments of the frame 14 are shown in FIGS. 2A through 2C. Though an equivalent frame 14 could be formed in plastic or other similar material, it is preferred that the frame 14 be constructed of metal wire or rods. The preferred rods are ⅛" diameter and made from steel. The rod frame 14 leaves the top substantially open which allows the customer to view the product when the receptacle 12 is completely in the frame. Further, the rod frame 14 is light weight and provides the high strength necessary for the bulk display of small but relatively heavy products such as screws, bolts, nuts, washers, etc.

Each frame 14 has a flange receiving area 18 on each side. The front portion of the metal slide rods 20 which comprise the flange receiving area 18 are supported by an angled support rod 22 which runs from the bottom of the back of the frame 14 to the underneath side of the slide rods 20. The flange receiving area rods or slide rods 20 are constructed by bending a single piece of metal rod 24 into the necessary shape shown in FIG. 2A, thereby providing a more rigid structure. Thus, the continuous metal rod 24 that forms the rod receiving area rods 20 also forms the two outside vertical support rods 26 and the bottom transverse support rod 28 on the back of the frame 14.

The frame 14 also includes two upper transverse support rods 30 and 32 which prevent relative motion between the ends of the flange receiving area rods 20. The front transverse support rod 32 ties the front end of the flange receiving area rods 20 together, and the back transverse support rod 30 ties the rear of the flange receiving area rods 20 together. The transverse support rods 30 and 32 also act as a base for the longitudinal support rods 34. The longitudinal support rods 34 may be attached to the top or underneath side of the transverse support rods 30 and 32. The large frame shown generally as 14A is shown in FIG. 2A, and because of its substantial width three longitudinal support rods 34 are incorporated into the frame 14A. FIG. 2B shows the medium frame shown generally as 14B. Three longitudinal support rods 34 are also used for the medium frame 14B to assure sufficient strength. FIG. 2C shows the small frame generally shown as 14C which has only one longitudinal support rod 34.

On the back of the frame 14 there are two additional inside vertical support rods 36. The inside vertical support rods 36 are more clearly illustrated in FIG. 3 which shows a rear view of the medium size frame 14B with a receptacle 12 partially slid into it. The two additional inside vertical support rods 36 provide the means for attaching the frame 14 to the peg board 16. At the top of the inside vertical rods 36 are J hooks 38, and at the bottom are stabilizing pins or pegs 40 which can be inserted into the peg board for additional stability while customers are sliding the receptacle 12 in and out and removing a product therefrom. The use of two J-hooks 38 is preferred, but additional J-hooks 38 could be added. If one of the alternate supports is used, the vertical rod 36 will incorporate eyelets for the insertion of screws or bolts or other similar attachment apparatus.

Figure 3:
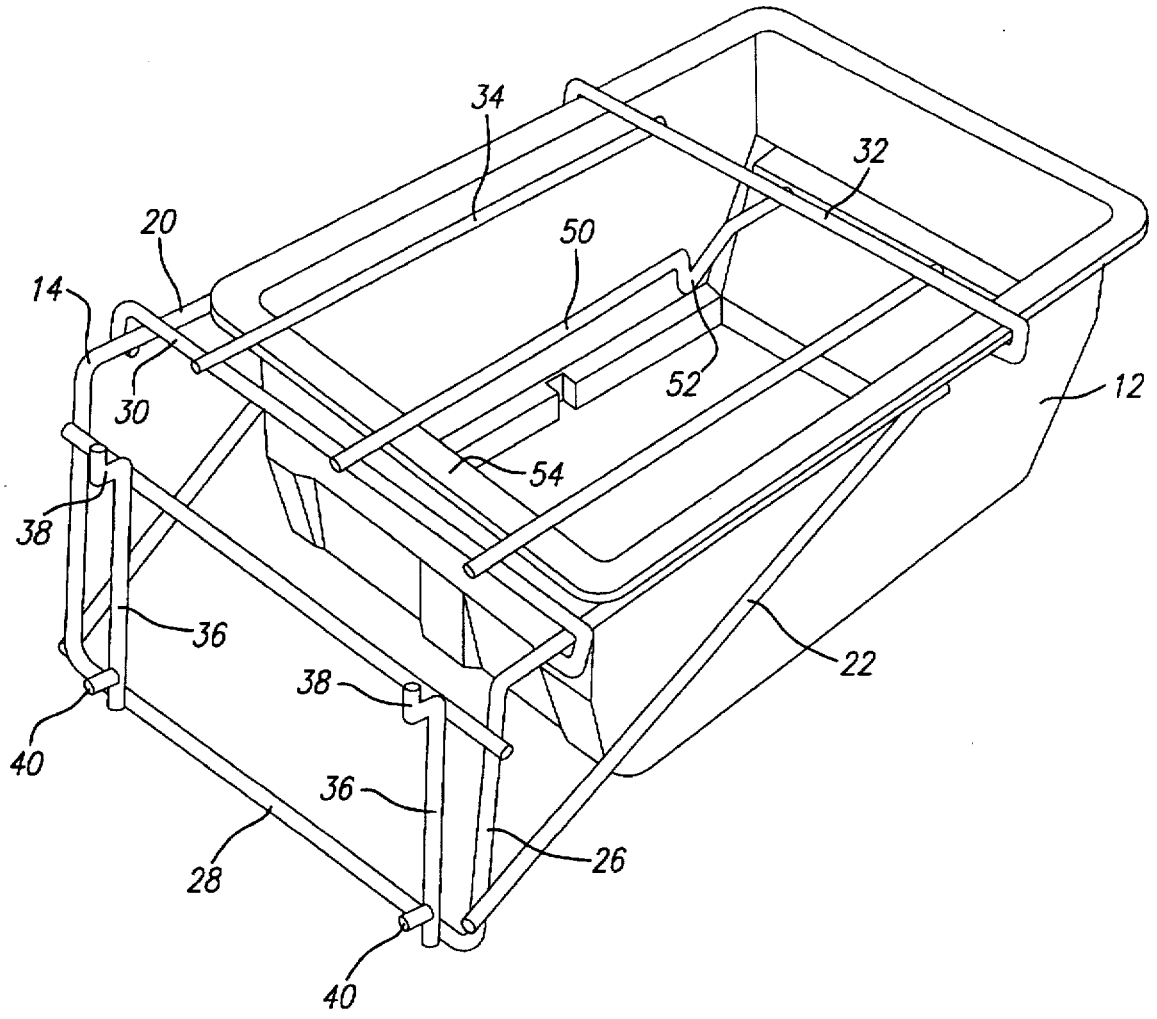
FIG. 3 is a perspective rear view of a frame having a receptacle slidably inserted therein with said receptacle partially slid into the frame.
Figure 4:
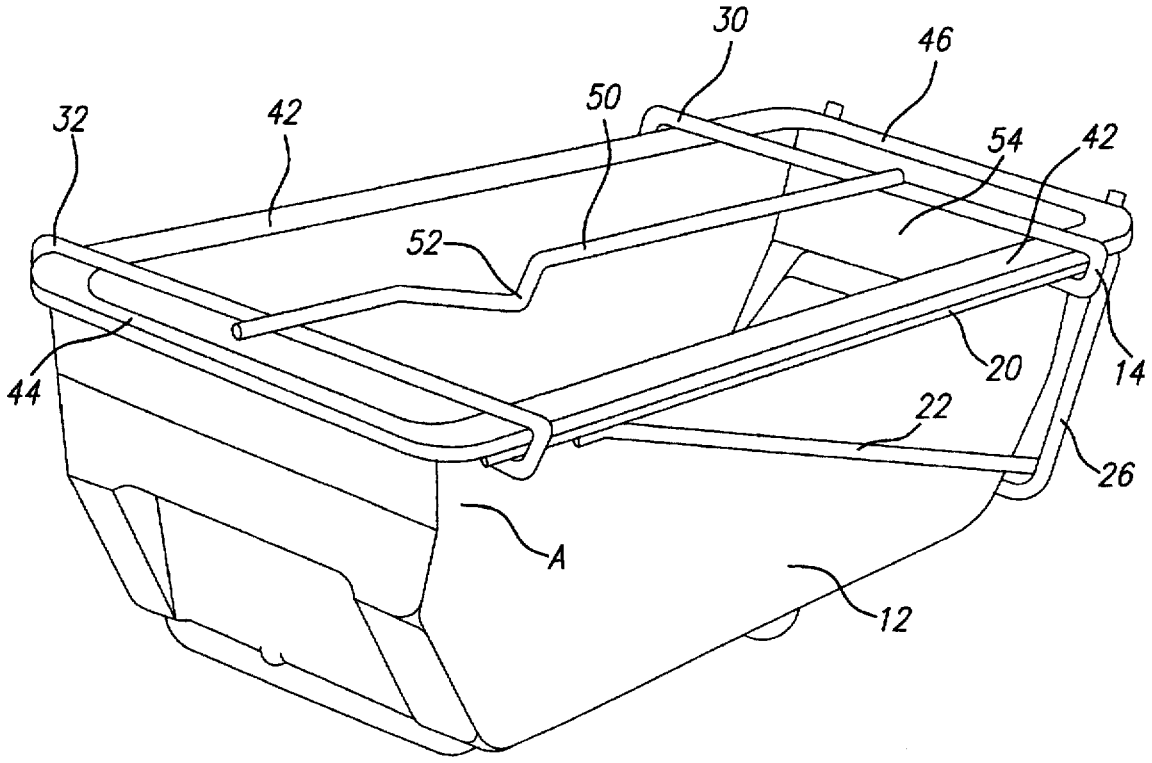
FIG. 4 is a perspective front view of a small frame and receptacle with the receptacle slid completely into the frame.

Also shown in FIG. 3 is a preferred embodiment of the receptacle 12. In a preferred embodiment, the receptacle 12 is constructed from a molded plastic such as polystyrene, polyethylene or styrene acrylonitrile. In FIG. 3, the receptacle 12 is shown in a position slightly forward in the frame 14. In comparison, FIG. 4 which is a front view of the small frame 14 and small receptacle 12 shows the receptacle 12 positioned all the way into the frame 14. Incorporated into each side of the receptacle is a flange 42. In a preferred embodiment of the invention, the flange 42 is located at the top of the receptacle 12; however, the flange 42 could be located lower on the side of the receptacle 12, at point A for example. On the top of the front of the receptacle 12 there is a lip 44 which acts as a handle. This type of handle is chosen because of the ease with which it is molded in plastic, but a conventional handle could be attached to the front of the receptacle 12. Thus, the receptacle 12 can slide back and forth in the frame 14 by pushing and pulling on the front lip or handle 44. The rear of the receptacle 12 also has a lip 46 at the top of the receptacle 12 to provide reinforcement. Further, on the lower portion of the front of the receptacle there is flat area 48 provided for the attachment of a label to identify products in the receptacle 12.

Referring again to the frame 14, the middle longitudinal support rod 50 incorporates a recessed or bent segment 52 located toward the front of the frame 14. The bent or recessed segment 52 acts as a stop 52 which engages the back or rear 54 of the receptacle when the receptacle 12 is pulled forward in the frame 14, thereby preventing the accidental removal of the receptacle 12 from the frame 14. The stop 52 is substantially immovable with respect to the frame 14 and is centrally located between the slide rods 20. If it is necessary to completely remove the receptacle 12 from the frame 14, the receptacle 12 may be forced past the stop 52. To allow the receptacle 12 to pass the stop 52 without a great amount of force, the back 54 of the receptacle is recessed slightly at the top. In FIG. 3, as the receptacle 12 is slid forward in the frame 14, the back 54 of the receptacle 12 eventually meets the stop 52 of the frame 14 thereby preventing the receptacle 12 from being completely removed from the frame 14 unless the recessed portion of the rear 54 of the receptacle 12 is forced over the stop 52. Thus, a specific intent and action is required to remove the receptacle 12 from the frame 14 and the stop 52 prevents a customer who is sliding the receptacle 12 out of the frame 14 to retrieve a product therefrom from accidently removing the receptacle.

Figure 5:
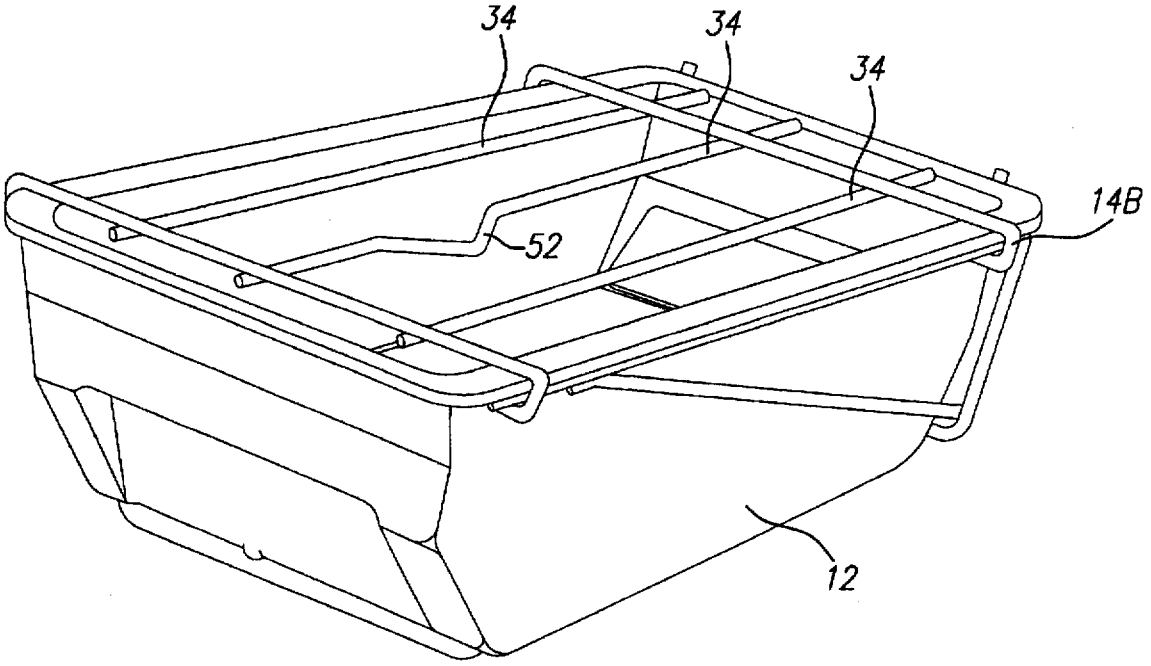
FIG. 5 is a perspective front view of a medium size frame and receptacle.
Figure 6:
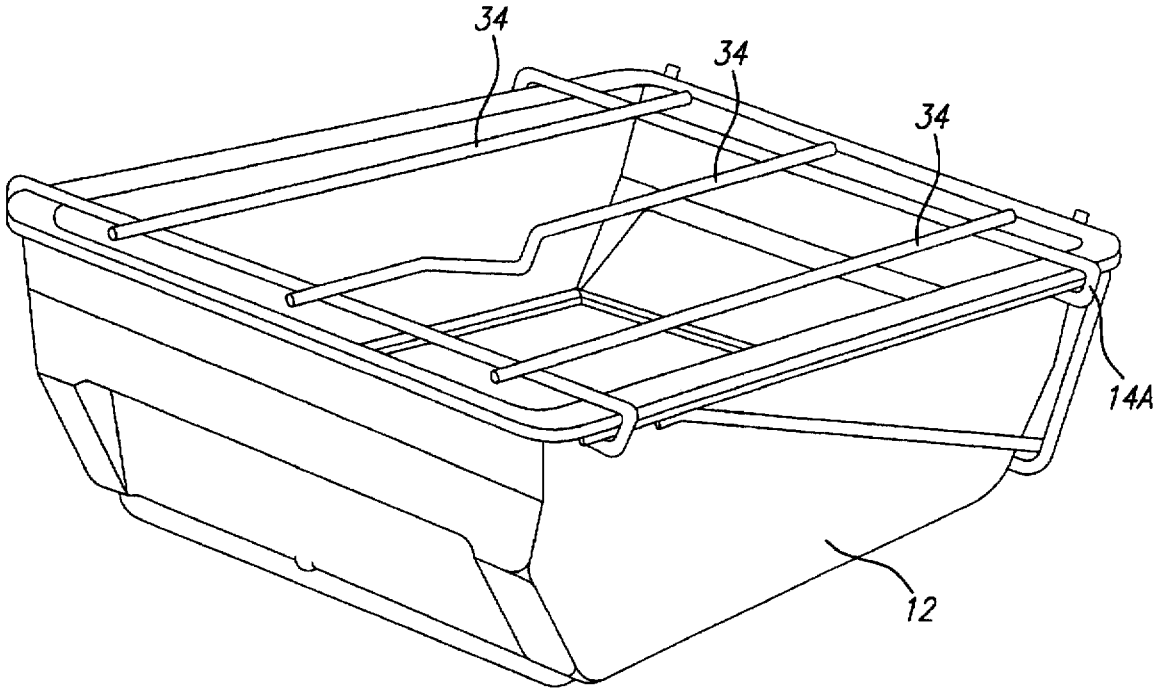
FIG. 6 is a perspective front view of a large size frame and receptacle.

In use, the flanges 42 of the receptacle 12 slide over the slide rods 20, so that customers may slide the receptacle 12 forward out of the frame 14, retrieve the product, and slide the receptacle 12 back into the frame 14. Further, the receptacles 12 and frames 14 may be of different sizes. A medium size receptacle 12 and frame 14B are shown in FIG. 5. The medium size frame 14B and receptacle 12 utilize a frame having three longitudinal support rods 34. A large size receptacle 12 and frame 14C are illustrated in FIG. 6. The large size frame 14C also utilizes three longitudinal support rods 34.

Figure 7:
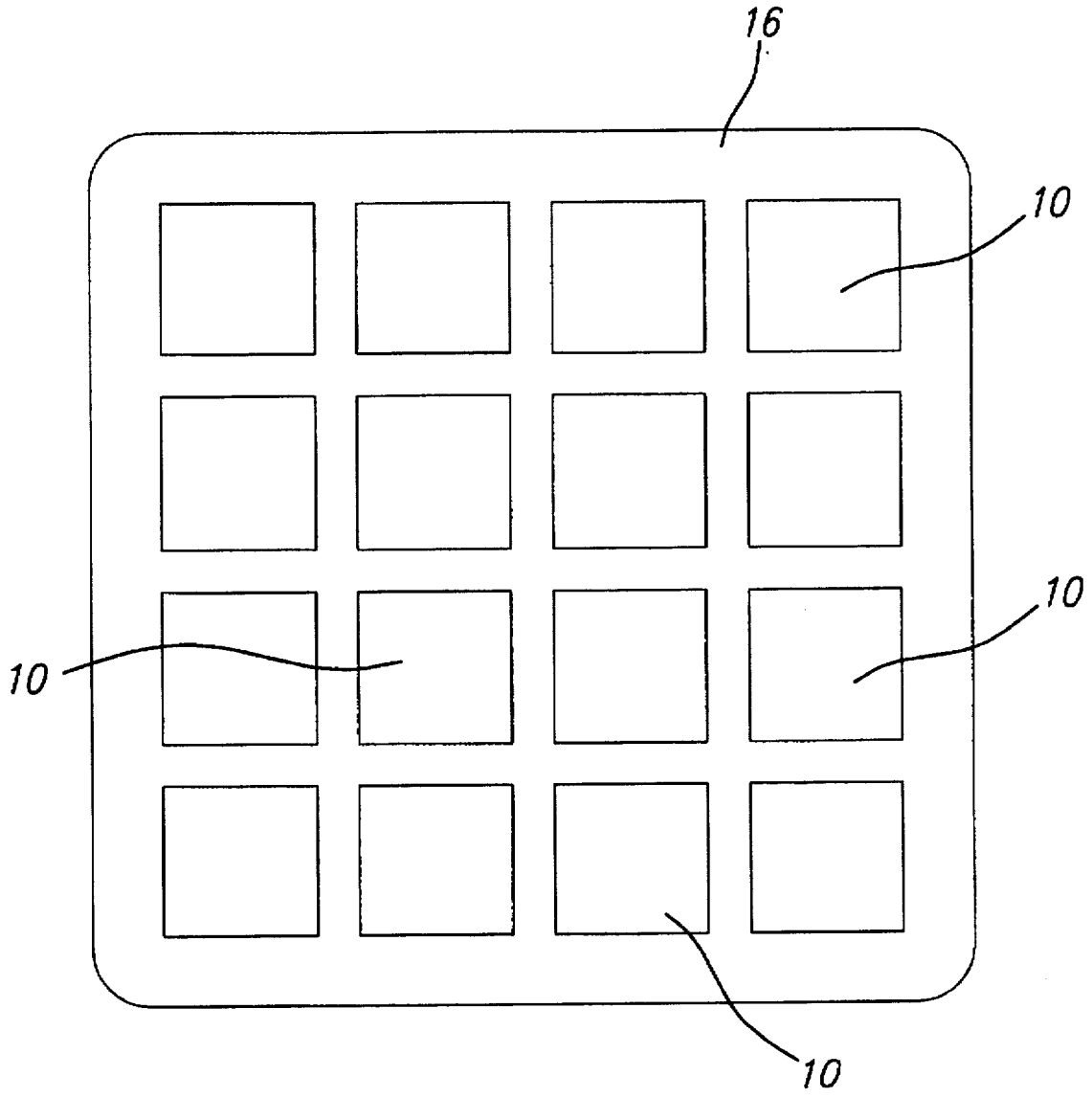
FIG. 7 is a schematic view of a plurality of frames and receptacles arranged on a peg board panel.

To utilize the disclosed display device the desired size of peg board 16 is hung on a wall, or a display having a peg board surface is placed in a store's showroom floor. The frame 14 is then attached to the peg board 16 by inserting the J-hooks 38 into two holes of the peg board and the stabilizing pins 40 are then placed in two holes below the holes which contain the J hooks 38. The receptacle 12 is then filled with the product to be displayed, and an appropriate label is placed on the label area 48 of the receptacle 12. The receptacle 12 is then slid into the frame 14. An entire display is completed by performing the same steps with multiple frames and receptacles on the surrounding peg board surface. The frame and receptacle units 10 may be arranged in any pattern including a tightly spaced column and row pattern as illustrated in FIG. 7.

Thus, a merchandise display device is disclosed which provides for the convenient and effective display in bulk of small sized, heavy products. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A merchandise display device comprising: a vertical support;

a frame having at least two connectors, said connectors attaching said frame to said support, and at least two flange receiving areas; and a receptacle having a flat flange, said flat flange being slidably received by said flange receiving areas.

2. The device of claim 1 wherein said support comprises a peg board having a plurality of holes, and said connectors comprise J-hooks inserted into said holes.

3. The device of claim 2 wherein said frame further comprises at least one stabilizing pin, each said stabilizing pin inserted into one of said holes.

4. The device of claim 1 wherein said frame comprises at least one longitudinal support rod having a recessed segment forming a stop, said stop engaging said receptacle and deterring removal of said receptacle from said frame.

5. The device of claim 4 wherein said stop is substantially immovable with respect to said frame and said stop is disengagable from said receptacle thereby allowing removal of said receptacle from said frame.

6. The device of claim 4 wherein said stop is centrally located with respect to said flange receiving areas.

7. The device of claim 1 wherein said receptacle comprises at least two sides, said sides having a top, said flange being attached to said top.

8. The device of claim 1 wherein said receptacle further comprises a handle and a label receiving area.

9. The device of claim 1 further comprising:

said support comprising a peg board having a plurality of holes;

a plurality of frames, each of said frames having at least two J-hooks, each said J-hook being inserted into a said hole, and an immovable central stop, said stop engaging said receptacle; and said frames being arranged in a tightly spaced column and row pattern on said peg board.

10. A merchandise display device comprising:

a pegboard support;

a rod frame having:

at least two connectors, said connectors securing said rod frame to said support, and at least two flange receiving areas; and a receptacle having a flange, said flange being slidably received by said flange receiving areas.

11. The device of claim 10 wherein said peg board support comprises a plurality of holes, and said connectors comprise J-hooks inserted into said holes.

12. The device of claim 11 wherein said rod frame further comprises at least one stabilizing pin, each of said stabilizing pins inserted into one of said holes.

13. The device of claim 10 wherein said frame comprises at least one longitudinal support rod having a recessed segment forming a stop, said stop engaging said receptacle, and deterring removal of said receptacle from said frame.

14. The device of claim 13 wherein said stop is substantially immovable with respect to said frame and said stop is disengagable from said receptacle thereby allowing removal of said receptacle from said frame.

15. The device of claim 13 wherein said stop is centrally located with respect to said flange receiving areas.

16. The device of claim 10 wherein said receptacle comprises at least two sides, said sides having a top, said flange being attached to said top.

17. The device of claim 10 wherein said receptacle further comprises a handle and a label receiving area.

18. The device of claim 10 further comprising:

said support comprising a peg board having a plurality of holes;

a plurality of frames, each of said frames having at least two J-hooks, each said J-hook being inserted into a said hole, and an immovable central stop, said stop engaging said receptacle; and said frames being arranged in a tightly spaced column and row pattern on said peg board.

19. A merchandise display device comprising:

a pegboard support having a plurality of holes;

a rod frame having at least two J hooks, said J hooks inserted into a separate hole thereby securing said rod frame to said support, at least one pin, inserted into one of said holes thereby stabilizing said rod frame relative to said support, at least two flange receiving areas, and a longitudinal support rod centrally located with respect to said flange receiving areas having a stop formed by a bent segment in said central support rod;

a receptacle having a front, rear, and two sides, each of said sides having a flange, said front having a lip, said rear having a central portion, said central portion being recessed, said rear engaging said stop, and said rear being disengagable from said stop, a label placement area on said front; and said flange being slidably placed in said flange receiving areas.

20. The device of claim 19 wherein said receptacle comprises a plastic and said frame comprises steel rods.

21. The device of claim 19 wherein said flange receiving areas are formed from a continuous rod.

* * * * *